US008000830B1

(12) United States Patent
Chao

(10) Patent No.: US 8,000,830 B1
(45) Date of Patent: Aug. 16, 2011

(54) METHOD OF MANUFACTURING MULTI-COLOR HOSIERY

(76) Inventor: Jim Chih-Neng Chao, Changhwa (TW)

( * ) Notice: Subject to any disclaimer, the term of this patent is extended or adjusted under 35 U.S.C. 154(b) by 0 days.

(21) Appl. No.: 12/785,684

(22) Filed: May 24, 2010

(51) Int. Cl.
*G06F 19/00* (2006.01)

(52) U.S. Cl. ..... 700/141; 66/138; 66/231

(58) Field of Classification Search ..... 66/140 R, 66/134, 138, 139, 141–144, 145 R, 231; 700/141, 700/131, 132, 133
See application file for complete search history.

(56) References Cited

U.S. PATENT DOCUMENTS 4,628,710 A * 12/1986 Jacobsson ..... 66/132 T
4,841,748 A * 6/1989 Watanabe et al. ..... 66/218
5,144,817 A * 9/1992 Tibbals, Jr. ..... 66/140 R
5,218,845 A * 6/1993 Wang ..... 66/139
5,964,106 A * 10/1999 Shibata et al. ..... 66/140 R
6,058,742 A * 5/2000 Dalmau Guell ..... 66/140 R
6,182,477 B1 * 2/2001 Shibata et al. ..... 66/232
6,269,282 B1 * 7/2001 Burger et al. ..... 700/131
6,810,696 B1 * 11/2004 Lonati ..... 66/134
7,036,343 B1 * 5/2006 Wei ..... 66/140 R

* cited by examiner

*Primary Examiner* — Danny Worrell
(74) *Attorney, Agent, or Firm* — Rosenberg, Klein & Lee

(57) ABSTRACT

A method of manufacturing multi-color hosiery comprises at least the steps of: a. providing a pattern knitter which has a main control computer to process color differentiation and set up yarn feeding commands according to a knitting color layout of hosiery; b. selecting total number of colored yarns and color types of pattern color yarns, and mounting the colored yarns on yarn racks, and arranging all knitting sets of a feeder support of the pattern knitter to match the colored yarns up to forty six different color types; and c. controlling yarn fingers through the main control computer according to sequence of the yarn feeding commands to perform knitting operation to finish a hosiery body. Any pattern color on the hosiery can be knitted to one row of the hosiery body. Up to nine to eleven color types can be deployed through the yarn fingers of each knitting set by adopting knitting operation without changing colored yarns on the same row, and up to twenty to forty six color types can be deployed through the yarn fingers of each knitting set for knitting the entire hosiery body by adopting knitting operation with changed colored yarns on the same row, thereby enhance aesthetic appeal and color diversity of the hosiery.

7 Claims, 6 Drawing Sheets

METHOD OF MANUFACTURING MULTI-COLOR HOSIERY

BACKGROUND OF THE INVENTION

1. Field of the Invention

The present invention relates to a method of manufacturing multi-color hosiery to provide desired colors in any patterns of hosiery such that nine to eleven color types can be knitted through yarn fingers of each knitting set by adopting knitting operation without changing colored yarns on the same row and twenty to forty six color types can be knitted for the entire hosiery body through the yarn fingers of each knitting set by adopting knitting operation with changed colored yarns on the same row thereby to enhance aesthetic appeal of the hosiery and color diversity.

2. Description of the Prior Art

Refer to FIG. 1 for an embodiment of a conventional hosiery 1 which has a body 10 with patterns formed with multiple color types 101, 102, 103, 104, 105, 106, 107, 108, 109, 110, 111, 112, 113, 114, 115, 116, 117, 118 and 119. In general, maximum nineteen different color types can be used to form the knitted patterns desired. In the process of knitting the body 10 the yarn fingers of each knitting set of a pattern knitter can provide maximum eight color types 101, 102, 103, 104, 105, 106, 107 and 108 on one row without changing colored yarns (shown between broken lines d and e in FIG. 1). When knitting the same row with changed colored yarns is adopted, one to nineteen color types can be knitted and deployed on the body 10, including 101, 102, 103, 104, 105, 106, 107, 108, 109, 110, 111, 112, 113, 114, 115, 116, 117, 118 and 119. Hence some high value multi-color patterns are made by printing to form the rich colored patterns on the hosiery. The knitted hosiery is elastic and extensible, but the patterns formed on the surface of the hosiery by printing cannot be extended flexibly, they are twisted and deformed when the hosiery is worn. Thus the conventional technique of knitting hosiery still has the aforesaid color constraint that makes increasing the added value of hosiery difficult, and also impairs the versatility of the hosiery for matching clothing.

SUMMARY OF THE INVENTION

In view of the aforesaid problem, the present invention aims to provide a method of manufacturing multi-color hosiery to enhance aesthetic appeal and diversified color selection for hosiery. According to the invention the yarn fingers of each knitting set can deploy nine to eleven color types by adopting knitting operation without changing colored yarns on the same row, and twenty to forty six color types can be deployed for knitting the entire hosiery through the yarn fingers of each knitting set by adopting knitting operation with changed colored yarns on the same row. Thus the aesthetic appeal and color diversity of the hosiery can be enhanced.

To achieve the foregoing object the manufacturing method of the invention includes steps as follow:

a. A pattern knitter contained a main control computer is provided to process color differentiation and set up yarn feeding commands according to a knitting color layout of hosiery;

b. Select total number of colored yarns and color types of pattern color yarns, and mount the colored yarns on yarn racks, and arrange all knitting sets of a feeder support of the pattern knitter to match the colored yarns up to forty six different color types; and c. The main control computer of the pattern knitter controls the yarn fingers to perform knitting operation according to the sequence of the yarn feeding commands to finish knitting of the hosiery.

At step c, through the yarn feeding commands and the yarn fingers of each knitting set nine to eleven color types can be knitted for the hosiery body by adopting knitting operation without changing colored yarns on the same row, and the entire hosiery can be knitted with maximum twenty to forty six color types through the yarn fingers by adopting knitting operation with changed colored yarns on the same row.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
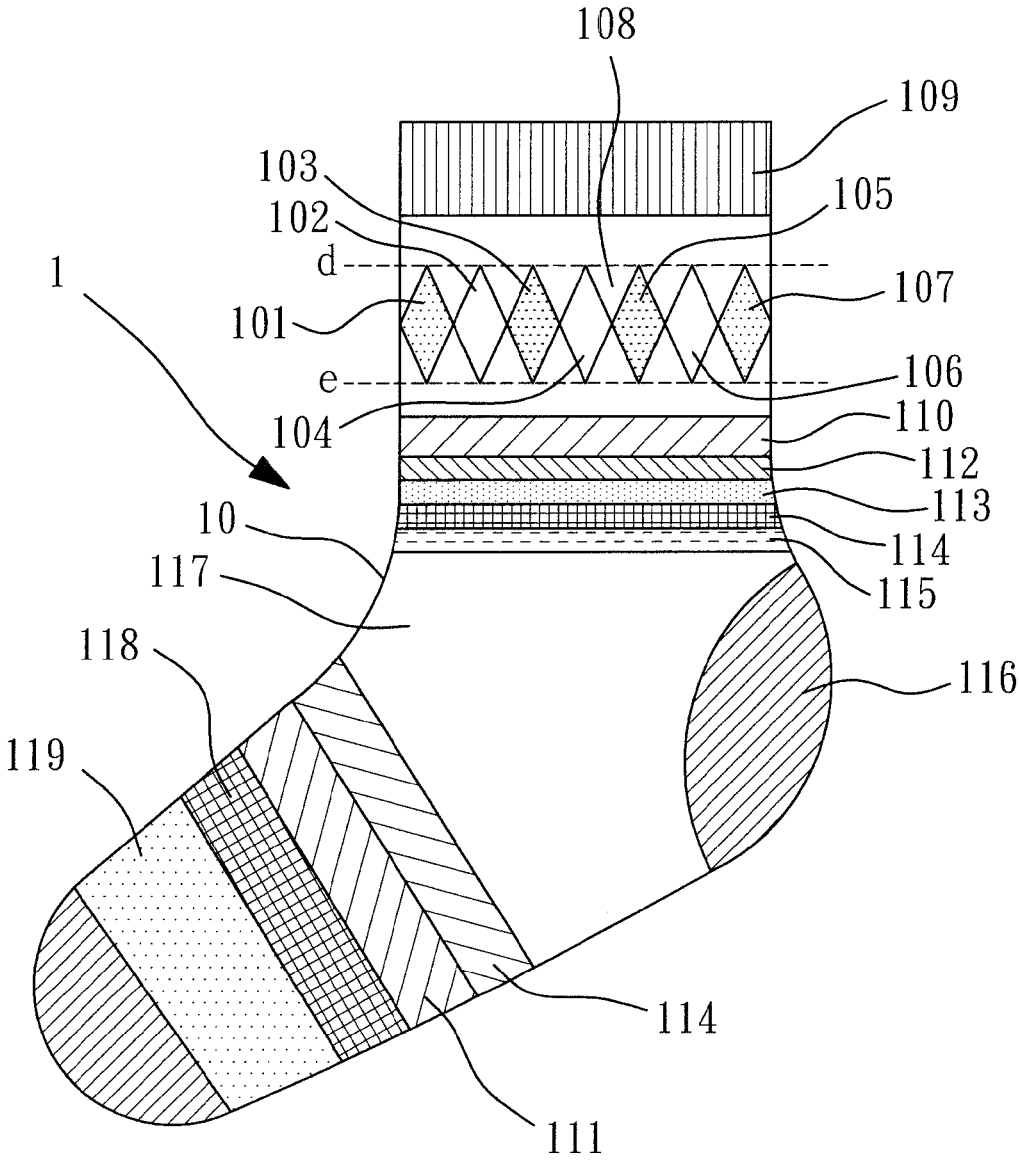
FIG. 1 PRIOR ART
FIG. 1 is a schematic view of a conventional hosiery colored pattern.
Figure 2:
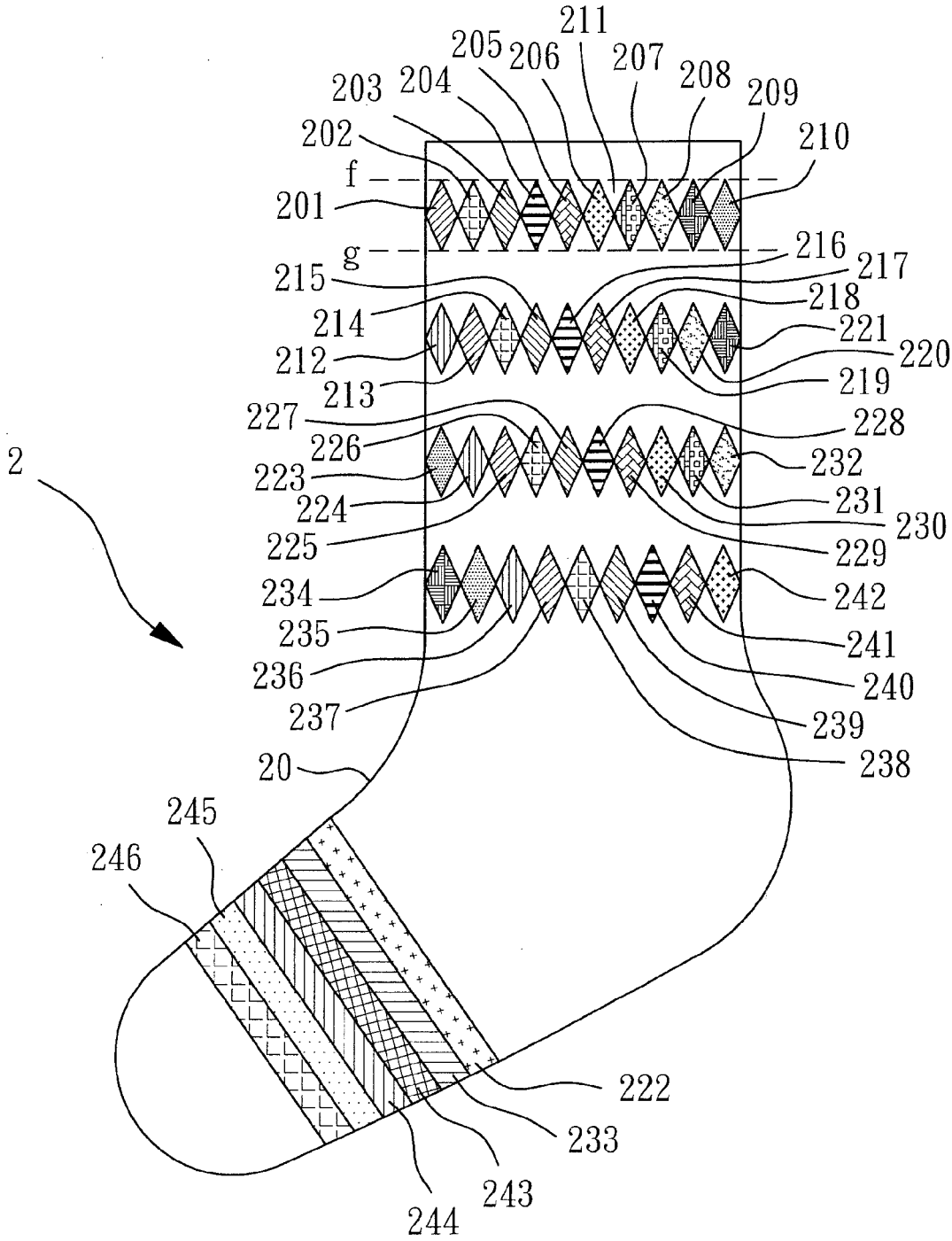
FIG. 2 is a schematic view of a hosiery colored pattern according to the invention.
Figure 3:
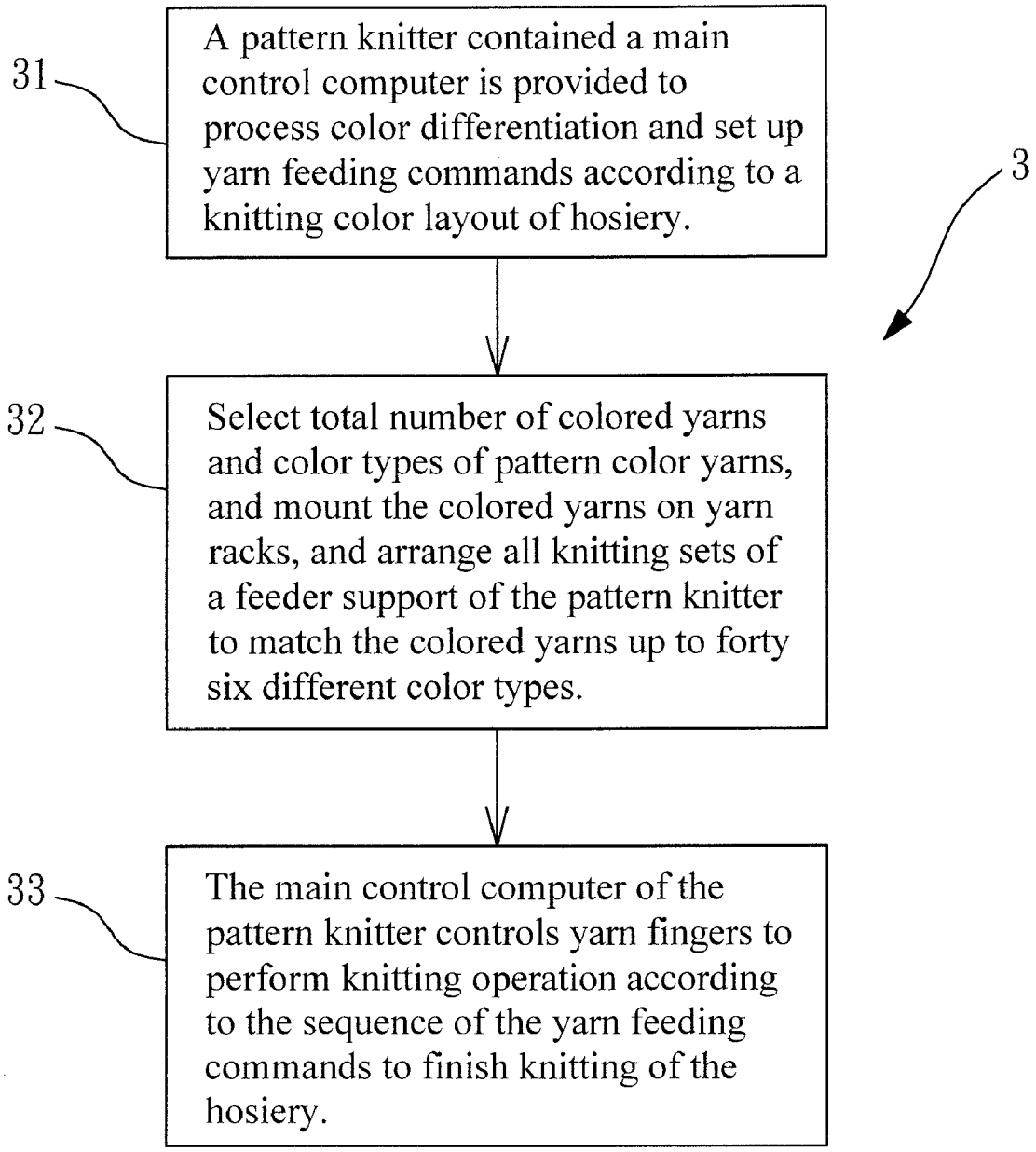
FIG. 3 is manufacturing steps according the method of the invention.
Figure 4:
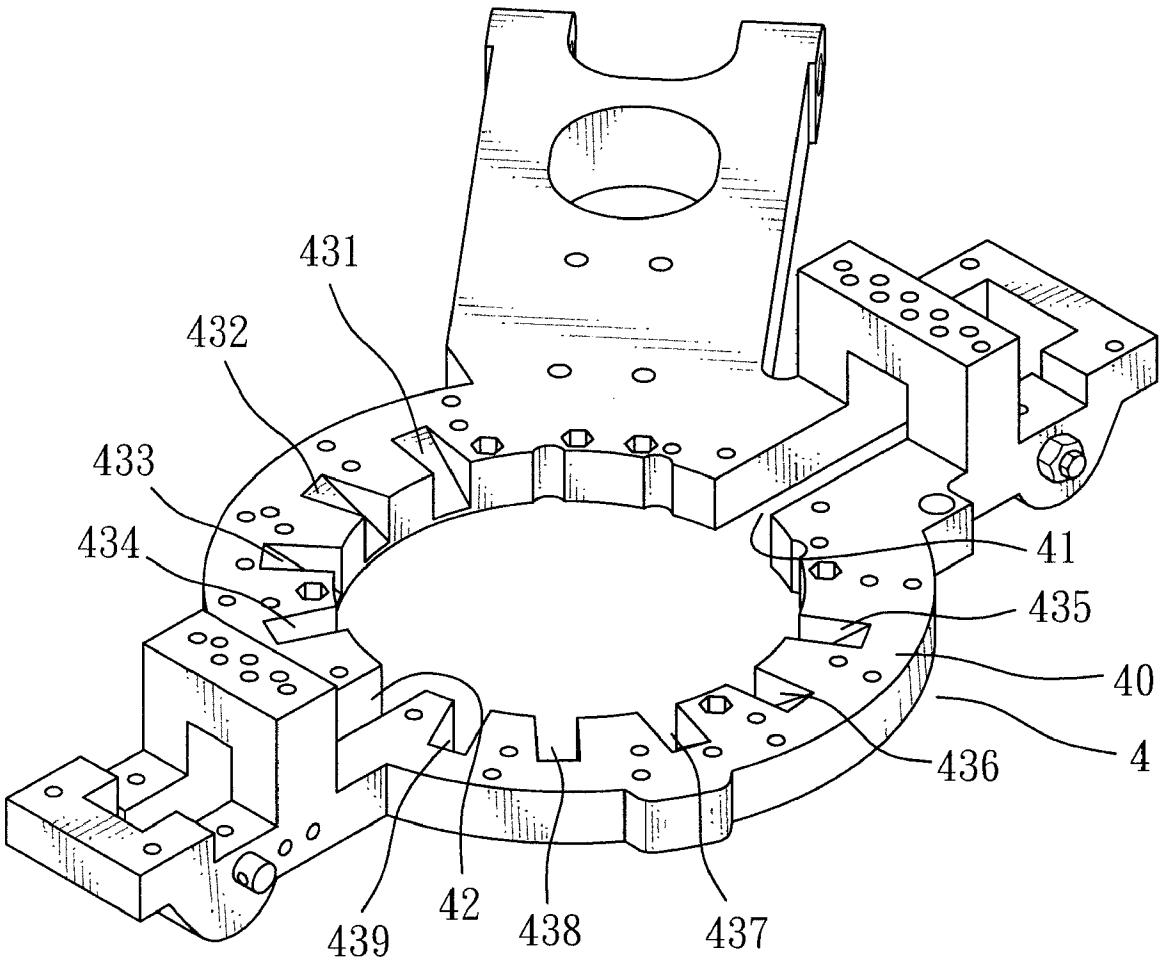
FIG. 4 is a schematic view of a yarn feeder housing according to the invention.
Figure 5:
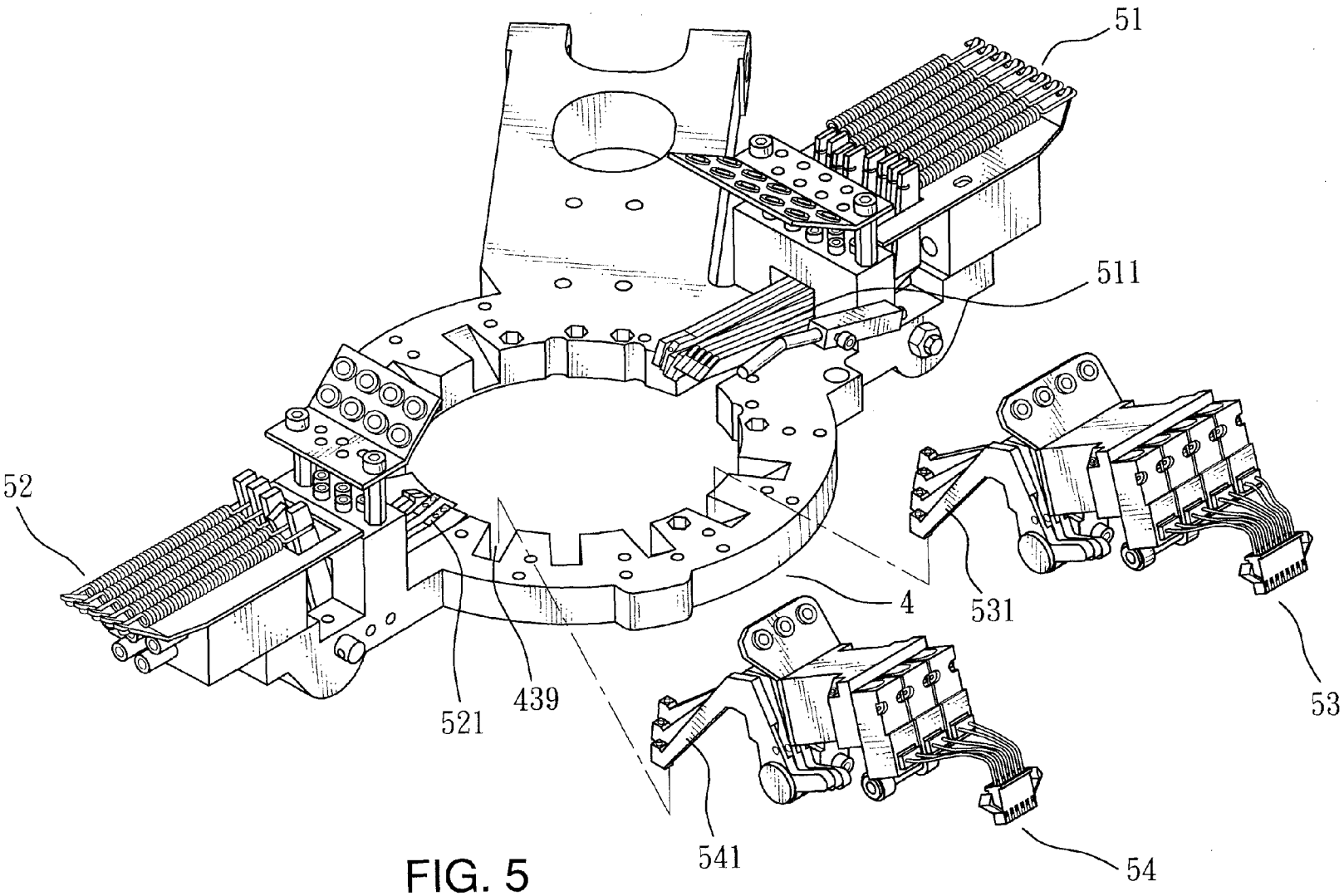
FIG. 5 is a schematic view of the feeder housing incorporating with knitting sets according to the invention.

Refer to FIG. 2 for an embodiment of a multi-color hosiery 2 knitted by the manufacturing method 3 of the invention. The hosiery 2 has a hosiery body 20 knitted through knitting needles with forty six color types 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245 and 246. For knitting one row on the body 20 (indicated between broken lines f and g in FIG. 2), maximum nine to eleven color types 201, 202, 203, 204, 205, 206, 207, 208, 209, 210 and 211 can be included. Compared with the conventional technique which can knit maximum 19 color types for the entire body, and only eight color types on one row, the invention provides a wider selection of patterns and colors to meet varying requirements, and layouts with maximum forty six color types are available for knitting. The manufacturing method 3 according to the invention includes at least the following steps (also referring to FIG. 3):

a. according to a color layout to be knitted for a hosiery, a pattern knitter is provided that has a main control computer to process color differentiation and set up yarn feeding commands (step 31): The main control computer processes color differentiation according to pattern color types 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245 and 246, and locations thereof on the hosiery 2, and arranges the sequence of each color type to a matching yarn finger, and enters yarn feeding commands according to the aforesaid sequence to control yarn feeding sequence of the knitting needles;

b. select total number of colored yarns and color types of pattern color yarns, and mount the colored yarns on yarn racks, and arrange all knitting sets of a feeder support of the pattern knitter to match the colored yarns up to forty six color types (step 32): based on pattern color types of the hosiery 2, select total number of colored yarns and color types of pattern color yarns (according to the number of the selected color types), and mount the colored yarns on the yarn racks to supply yarn feeding required by yarn fingers 511, 521, 531 and 541 of the feeder support 4; referring to FIGS. 4 and 5, the feeder support 4 of the pattern knitter has a housing 40 containing a first main feed 41, a second main feed 42, a first pattern feed 431, a second pattern feed 432, a third pattern feed 433, a fourth pattern feed 434, a fifth pattern feed 435, a sixth pattern feed 436, a seventh pattern feed 437, an eighth pattern feed 438 and a ninth pattern feed 439. The first main feed 41 has a matching first main yarn set 51 installed thereon, and the second main feed 42 has a matching second main yarn set 52 installed thereon (also referring to FIG. 5). The first through the eighth pattern feeds 431, 432, 433, 434, 435, 436, 437 and 438 have respectively a matching first yarn feeder set 53 installed thereon, and the ninth pattern feed 439 has a matching second yarn feeder set 54 installed thereon. The knitting set on the feeder support 4 previously discussed is the general term for either of the first main yarn set 51, second main yarn set 52, first yarn feeder set 53 or second yarn feeder set 54. The first main yarn set 51 includes eight yarn fingers 511, among them six yarn fingers 511 can be deployed with six colored yarns. The second main yarn set 52 includes five yarn fingers 521 to deploy five colored yarns. Each of the eight first yarn feeder sets 53 has four yarn fingers 531 to deploy four colored yarns. Because of limited housing space, the second yarn feeder set 54 installed on the ninth pattern feed 439 can hold only three yarn fingers 541 to deploy three colored yarns. In other words, the first yarn feeder set 53 can hold four yarn fingers 531, the second yarn feeder set 54 can hold three yarn fingers 541, and each of the yarn fingers 531 and 541 can deploy one colored yarn. Hence all the knitting sets (including one first main yarn set 53, one second main yarn set 54, eight first yarn feeder sets 53 and one second yarn feeder set 54) on the feeder support 4 can deploy up to forty six different colored yarns to supply yarn feeding of the pattern knitter; and c. the main control computer of the pattern knitter controls the yarn fingers during knitting process according to the sequence of the yarn feeding commands to finish knitting of the hosiery body 20 (step 33): the yarns are fed to the yarn fingers 511, 521, 531 and 541 through the yarn feeding commands of the main control computer, and maximum forty six color types can be knitted on the hosiery body 20.

At step 33 (i.e. step c) previously discussed, under the yarn feeding command, the yarn fingers 511, 521, 531 and 541 of each knitting set (namely first main yarn set 51, second main yarn set 52, first yarn feeder set 53 and second yarn feeder set 54) can knit up to nine to eleven color types for the hosiery body 20 by adopting knitting operation without changing colored yarns on the same row (i.e. each of the first main yarn set 51, second main yarn set 52, eight first yarn feeder sets 53 and second yarn feeder set 54 provides one yarn finger 511, 521, 531 or 541 to knit maximum eleven color types, while the conventional technique can only knit maximum eight color types under the same condition, i.e. the invention can knit more than eight color types to reach between nine to eleven color types by adopting knitting operation without changing colored yarns on the same row).

On the other hand, at step 33, in another condition, under the yarn feeding command the yarn fingers 511, 521, 531 and 541 of each knitting set (namely first main yarn set 51, second main yarn set 52, first yarn feeder set 53 and second yarn feeder set 54) can knit up to twenty to forty six color types on the entire hosiery body 20 on the same row with changed colored yarns (while the conventional technique can only reach maximum nineteen color types), i.e. the first main yarn set 51 providing six yarn fingers 511 and second main yarn set 52 providing five yarn fingers 521 to become eleven color types, and the eight first yarn feeder sets 53 each providing four yarn fingers 531 to become 32 color types, and the second yarn feeder set 54 providing three yarn fingers 541 to become 3 color types. Thus, in total there are forty six color types in yarn feeding operation.

Figure 6:
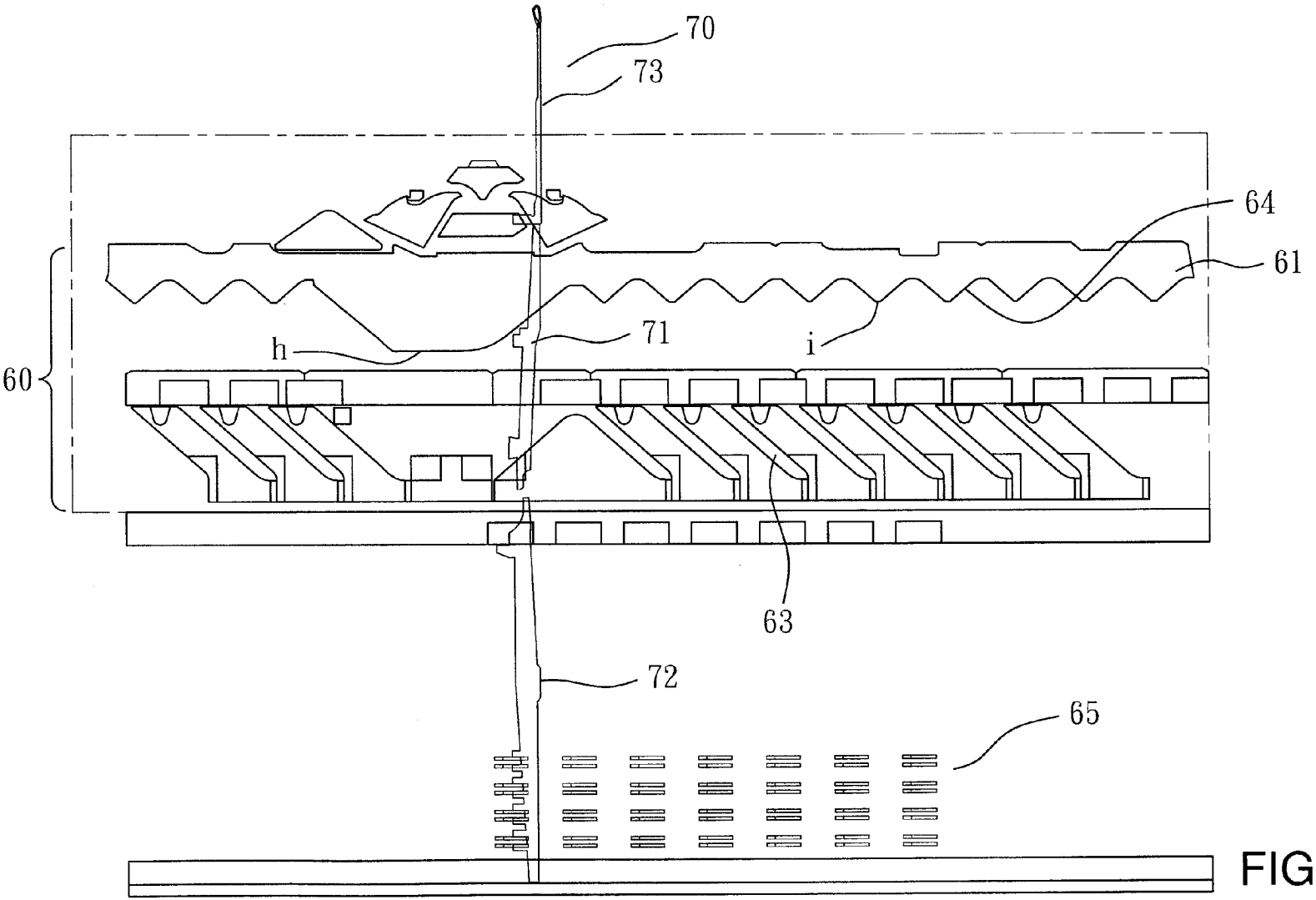
FIG. 6 is a schematic view of the invention showing yarn feeding and pattern forming operation.

Referring to FIG. 6, when the invention is in use to perform pattern knitting operation, an actuator 65 pushes an actuator jack 72 of a knitting element 70, through a lever principle a middle jack 71 is moved on a cam 60 along a raising cam 63 to push a knitting needle 73 to pick up a yarn on the knitting set. Through guiding of a jack lower cam 61 the middle jack 71 of the knitting element 70 is lowered to the lowest spot i of a guiding surface 64, and the jack lowering cam 61 of the first main feed 41 is positioned at a spot which is also at the lowest spot h of the guiding surface 64 where the middle jack 71 is lowered, meanwhile needle retraction takes place. Incorporating with the nine pattern feeds 431, 432, 433, 434, 435, 436, 437, 438 and 439, and the first main feed 41 and second main feed 42, each knitting set (namely first main yarn set 51, second main yarn set 52, first yarn feeder set 53 and second yarn feeder set 54) can knit nine to eleven color types by adopting knitting operation without changing colored yarns on the same row, and can knit twenty to forty six color types for the entire hosiery body 20 by adopting knitting operation with changed colored yarns on the same row.

The manufacturing method provided by the invention set forth above provides a biggest feature by overcoming the limitation of the conventional technique that can knit only one to nineteen color types and encounters a bottleneck of knitting merely eight color types on the same row without changing colored yarns. The method of the invention (step 3) provides an advanced process to knit up to forty six color types for the entire hosiery body, and up to nine to eleven color types by adopting knitting operation without changing colored yarns on the same row. However, it does not mean that the invention cannot knit one to nineteen color types for the hosiery. More specifically, the invention can knit hosiery with one to forty six color types at step 3, with one to eleven color types by adopting knitting operation without changing colored yarns on the same row, and in the condition of having the knitting sets on the same row with changed colored yarns, one to forty six color types can be knitted for the entire hosiery body. To high light the difference between the invention and conventional technique, the manufacturing method of the invention previous discussed offers more emphasis on the feature of knitting the entire hosiery body with maximum forty six color types, and nine to eleven color types by adopting knitting operation without changing colored yarns on the same row.

As a conclusion, the manufacturing method provided by the invention can knit up to forty six color types for the entire hosiery body, and nine to eleven color types by adopting knitting operation without changing colored yarns on the same row. The hosiery thus formed has more diversified colors and enhanced aesthetic appeal.

I claim:

1. A method of manufacturing multi-color hosiery comprising the steps of:

providing a pattern knitter which contains a main control computer to process color differentiation and set up yarn feeding commands according a knitting color layout of a hosiery;

selecting total number of colored yarns and color types of pattern color yarns, mounting the colored yarns on yarn racks, and arranging all knitting sets of a feeder support of the pattern knitter to match the colored yarns up to forty six different color types, the feeder support comprising a plurality of main feeds respectively coupled to a plurality of main yarn sets, a plurality of yarn feeder sets each coupled to at least one pattern feed;

wherein each of the main yarn sets and yarn feeder sets includes a plurality of yarn fingers engaging the colored yarns; and controlling yarn fingers through the main control computer according to sequence of the yarn feeding commands to perform knitting operation to finish a hosiery body.

2. The method of claim 1, wherein a first main yarn set contains eight yarn fingers, a subset of the eight yarn fingers maintaining engagement of colored yarn having a single color throughout the knitting operation.

3. The method of claim 1, wherein a second main yarn set contains five yarn fingers each maintaining engagement of colored yarn having a single color throughout the knitting operation.

4. The method of claim 1, wherein the first yarn feeder set contains four yarn fingers each maintaining engagement of colored yarn having a single color throughout the knitting operation.

5. The method of claim 1, wherein the second yarn feeder set contains three yarn fingers each maintaining engagement of colored yarn having a single color throughout the knitting operation.

6. The method of claim 1, wherein the main control computer controls the yarn fingers according to the sequence of the yarn feeding commands to perform knitting operation and finish knitting of the hosiery body in such a fashion that the hosiery body containing over nine color types by adopting knitting operation without changing colored yarns on the same course through changing the yarn fingers of each knitting set during knitting of that course.

7. The method of claim 1, wherein the hosiery body contains up to forty six color types through the yarn fingers of each knitting set by adopting knitting operation with changed yarn finger on the same course.

* * * * *